US007513743B2

(12) United States Patent
Liang

(10) Patent No.: US 7,513,743 B2
(45) Date of Patent: Apr. 7, 2009

(54) TURBINE BLADE WITH WAVY SQUEALER TIP RAIL

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 459 days.

(21) Appl. No.: 11/415,729

(22) Filed: May 2, 2006

(65) Prior Publication Data

US 2007/0258815 A1 Nov. 8, 2007

(51) Int. Cl.
*F01D 5/18* (2006.01)
*F01D 11/00* (2006.01)

(52) U.S. Cl. ..... 416/92; 416/97 R; 416/235; 415/173.6

(58) Field of Classification Search ..... 415/173.1, 415/173.6; 416/92, 96 R, 97 R, 228, 235
See application file for complete search history.

(56) References Cited

U.S. PATENT DOCUMENTS 3,635,585 A * 1/1972 Metzler, Jr. ..... 416/96 R
4,424,001 A * 1/1984 North et al. ..... 416/92
4,606,701 A * 8/1986 McClay et al. ..... 416/92
4,682,933 A 7/1987 Wagner
4,875,831 A 10/1989 Fetiveau
5,503,527 A * 4/1996 Lee et al. ..... 416/91
5,564,902 A * 10/1996 Tomita ..... 416/97 R
5,733,102 A * 3/1998 Lee et al. ..... 416/97 R
5,738,491 A 4/1998 Lee et al.
5,997,251 A 12/1999 Lee
6,027,306 A * 2/2000 Bunker ..... 415/173.5
6,059,530 A * 5/2000 Lee ..... 416/97 R
6,179,556 B1 1/2001 Bunker
6,190,129 B1 * 2/2001 Mayer et al. ..... 416/97 R
6,224,336 B1 * 5/2001 Kercher ..... 416/97 R
6,478,537 B2 11/2002 Junkin
6,602,052 B2 8/2003 Liang
6,652,235 B1 * 11/2003 Keith et al. ..... 416/92
6,824,359 B2 * 11/2004 Chlus et al. ..... 416/92
6,837,687 B2 * 1/2005 Lee et al. ..... 416/224
6,916,150 B2 7/2005 Liang
6,971,851 B2 12/2005 Liang
6,991,430 B2 1/2006 Stec et al.
7,059,834 B2 * 6/2006 Chlus et al. ..... 416/92

* cited by examiner

*Primary Examiner*—Edward Look
*Assistant Examiner*—Sean J Younger

(57) ABSTRACT

A turbine blade (10) including an airfoil (12), the airfoil (12) including an airfoil outer wall (16) having pressure and suction sidewalls (18, 20) joined together at chordally spaced apart leading and trailing edges (22, 24) extending radially outwardly from a blade root (14) to a blade tip surface (30). A continuous squealer tip rail (40) extends radially outwardly from and substantially continuously around the blade tip surface (30) forming a radially outwardly open squealer pocket (46). The squealer tip rail (40) includes an aft portion (54) adjacent to the trailing edge (24). The aft portion (54) traverses the blade tip surface (30) between the pressure and suction sidewalls (18, 20) in a curved undulating path to define alternating forward and rearward facing pockets (56, 58, 60, 62). Each of the forward and rearward facing pockets (56, 58, 60, 62) includes a cooling hole (64*a*, 64*b*, 64*c*, 64*d*) in fluid communication with a cooling fluid circuit (49) within the airfoil (10).

18 Claims, 4 Drawing Sheets

TURBINE BLADE WITH WAVY SQUEALER TIP RAIL

BACKGROUND OF THE INVENTION

1. Field of the Invention

The present invention relates generally to gas turbine blades and, more particularly, to a blade squealer rail located along the tip of a turbine blade.

2. Related Prior Art

In a turbomachine, such as a gas turbine engine, air is pressurized in a compressor then mixed with fuel and burned in a combustor to generate hot combustion gases. The hot combustion gases are expanded within the turbine section where energy is extracted to power the compressor and to produce useful work, such as powering a propeller for an aircraft in flight or turning a generator to produce electricity. The hot combustion gas travels through a series of turbine stages. A turbine stage may include a row of stationary vanes followed by a row of rotating turbine blades, where the turbine blades extract energy from the hot combustion gas for powering the compressor and providing output power. Since the turbine blades are directly exposed to the hot combustion gas, they are typically provided with internal cooling circuits which channel a coolant, such as compressor bleed air, through the airfoil of the blade and through various film cooling holes around the surface thereof. One type of airfoil extends from a root at a blade platform, which defines the radially inner flowpath for the combustion gas, to a radially outer cap or blade tip section, and includes opposite pressure and suction sides extending axially from leading to trailing edges of the airfoil. The cooling circuit extends inside the airfoil between the pressure and suction sides and is bounded at its top by the blade tip section.

The gas turbine engine efficiency is, at least in part, dependant upon the extent to which the high temperature gases leak across the gap between the turbine blade tips and the seals or shrouds which surround them. The leakage quantity is typically minimized by positioning the radially-outward blade tip section in close proximity to the outer air seal. However, differential thermal elongation and dynamic forces between the blade tip section and outer air seal can cause rubbing therebetween. Also, it should be noted that the heat load on the turbine blade tip section is a function of leakage flow over the blade tip section. Specifically, a high leakage flow will induce a high heat load to the blade tip section, such that gas leakage across the blade tip section and cooling of the blade tip section have to be addressed as a single problem. In a typical construction, see FIG. 6, the blade tip section 104 of an airfoil 100 has been provided with a squealer tip rail 102 extending radially outwardly a short distance from the blade tip section 104, and extending substantially completely around the perimeter of the airfoil 100 to define an inner squealer tip pocket 106 facing radially outwardly. The squealer tip rail 102 is provided for spacing radially closely adjacent to a stationary outer seal wall, or outer turbine shroud, to provide a relatively small clearance gap therebetween to seal or restrict the flow of gas across the blade tip section 104.

The squealer tip rail 102 is a solid metal projection of the airfoil 100, and is directly heated by the combustion gas which flows thereover, as illustrated by flow lines 108. In addition, a vortex flow 110 of hot gases may be formed on the suction side of the airfoil 100 adjacent the blade tip. The squealer tip rail 102 is cooled by a cooling fluid, such as air, channeled from an airfoil cooling circuit to the blade tip section 104 to convect heat away the area of the squealer tip pocket 106. Convective cooling holes 114 may be provided in the squealer tip pocket 106 located along the squealer tip rail 102, as illustrated in FIG. 6. In addition, heat from the squealer tip rail 102 may be conducted into the squealer tip section 104 and convected away internally of the airfoil 100 by the cooling fluid channeled through the internal cooling circuit. The squealer tip section 104, including the squealer tip rail 102, typically operates at temperatures above that of the remainder of the airfoil 100 and can be a life limiting element of the airfoil 100 in a hot turbine environment. In particular, it is known in the art that the portion of the airfoil 100 located at the intersection of the pressure side airfoil surface 118 and the blade tip section 104 is subject to very high heat loads and accordingly is more likely to experience thermal distress.

Cooling to the pressure side airfoil surface 118 may be provided by a row of film cooling holes 116 located on the pressure side of the airfoil outer wall, extending from the leading edge to the trailing edge of the airfoil 102, immediately below the blade tip section 104 for providing a cooling fluid film which flows upwardly over the pressure side of the airfoil 100.

Referring to FIG. 7, an enlarged view of the trailing edge of the airfoil 100 of FIG. 6 is illustrated, where it may be seen that the aft end of the squealer tip rail 102 is discontinued on the side adjacent the pressure side surface 118 to form a single squealer tip rail 102*a* located on the suction side of the airfoil 100, which extends to the trailing edge of the airfoil 100. As a result primarily of the squealer pocket geometry and the interaction of hot gas secondary flow mixing, the effectiveness of the cooling fluid provided from the pressure side film holes 116 and from the cooling holes 114 in the bottom of the squealer pocket 106 at the aft end is very limited, such that the aft end of the suction side squealer rail 102*a* is substantially exposed to heating from three sides. As a consequence, the blade trailing edge tip section generally exhibits increased oxidation and erosion, adversely affecting the operating life of the turbine blade.

SUMMARY OF THE INVENTION

In accordance with one aspect of the invention, a turbine blade is provided comprising an airfoil including an airfoil outer wall extending radially outwardly from a blade root. A blade tip surface is located at an end of the airfoil distal from the root, and includes pressure and suction sides joined together at chordally spaced apart leading and trailing edges of the airfoil. A squealer tip rail extends radially outwardly from the blade tip surface and includes an aft portion extending between the leading edge and the trailing edge adjacent to the trailing edge. The aft portion continuously traverses the blade tip surface from the suction side toward the pressure side and back toward the suction side.

In accordance with another aspect of the invention, a turbine blade is provided comprising an airfoil including an airfoil outer wall having pressure and suction sidewalls. The pressure and suction sidewalls are joined together at chordally spaced apart leading and trailing edges of the airfoil and extend radially outwardly from a blade root to a blade tip surface. The blade tip surface includes pressure and suction sides coinciding with the pressure and suction sidewalls. A continuous squealer tip rail extends radially outwardly from and substantially continuously around the blade tip surface forming a radially outwardly open squealer pocket. The squealer tip rail includes an aft portion adjacent to the trailing edge, the aft portion traversing the blade tip surface between the pressure side and the suction side in a curved undulating path to define alternating forward and rearward facing pockets.

In accordance with a further aspect of the invention, a turbine blade is provided comprising an airfoil including an airfoil outer wall having pressure and suction sidewalls. The pressure and suction sidewalls are joined together at chordally spaced apart leading and trailing edges of the airfoil and extend radially outwardly from a blade root to a blade tip surface. The blade tip surface includes pressure and suction sides coinciding with the pressure and suction sidewalls. A continuous squealer tip rail extends radially outwardly from and substantially continuously around the blade tip surface forming a radially outwardly open squealer pocket. The squealer tip rail includes an aft portion adjacent to the trailing edge, the aft portion traversing the blade tip surface between the pressure side and the suction side in a curved undulating path to define alternating forward and rearward facing pockets. A plurality of cooling holes are provided in fluid communication with a cooling fluid circuit within the airfoil, the cooling holes are located in the blade tip surface within the forward and rearward facing pockets.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

The present invention provides a construction for the blade tip section of a rotating blade for a combustion gas turbine, where the blade tip section includes a squealer tip rail that is configured to provide a reduction in the vena contractor associated with secondary leakage flow passing the blade tip section. The geometry of the squealer tip rail operates in combination with an injected cooling flow to reduce blade leakage flow and heat load.

Figure 1:
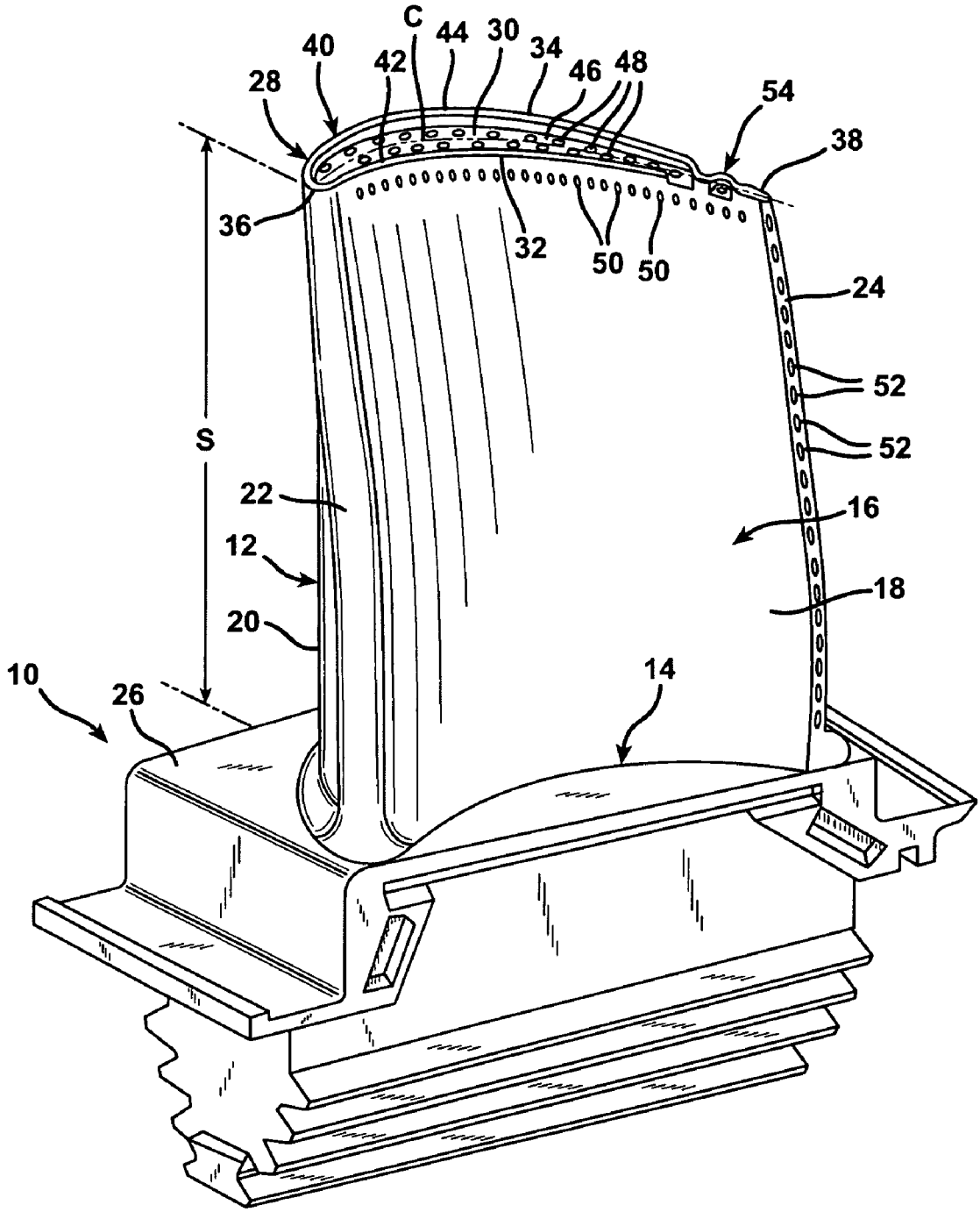
FIG. 1 is a perspective view of a representative turbine blade incorporating a squealer tip rail constructed in accordance with the principles of the present invention.

Referring to FIG. 1, an exemplary turbine blade 10 for a gas turbine engine is illustrated. The blade 10 includes an airfoil 12 and a root 14 which is used to conventionally secure the blade 10 to a rotor disk of the engine for supporting the blade 10 in the working medium flow path of the turbine where working medium gases exert motive forces on the surfaces thereof. The airfoil 12 has an outer wall 16 comprising a pressure sidewall 18 and a suction sidewall 20. The pressure and suction sidewalls 18, 20 are joined together along an upstream leading edge 22 and a downstream trailing edge 24, where the leading and trailing edges 22, 24 are spaced axially or chordally from each other with respect to a chordal direction C. The airfoil 12 extends radially along a longitudinal or radial direction of the blade 10, defined by a span S of the airfoil 12, from a radially inner airfoil platform 26 to a radially outer squealer tip cap or squealer tip section 28.

The squealer tip section 28 includes a blade tip surface 30 having an airfoil shape, and pressure and suction sides 32, 34 which are joined together at chordally spaced apart leading and trailing edges 36, 38 of the squealer tip section 28. The pressure and suction sides 32, 34 coincide with the pressure and suction sidewalls 18, 20, respectively, of the airfoil 12. A squealer tip rail 40 extends radially outwardly from the blade tip surface 30 and comprises a pressure side tip rail 42 and a suction side tip rail 44. The pressure side tip rail 42 and suction side tip rail 44 define a substantially continuous wall extending outwardly from and around the periphery of the outer wall 16, to form a radially outwardly open main squealer tip pocket 46 therein.

Squealer pocket cooling holes 48 are formed in the blade tip surface 30 within the main squealer tip pocket 46 to provide a cooling fluid flow in a conventional manner from a cooling fluid circuit 49 extending through the airfoil 12 and in fluid communication with the squealer pocket cooling holes 48. The squealer pocket cooling holes 48 generally extend along the periphery of the main squealer tip pocket 46 adjacent to the pressure side tip rail 42 and suction side tip rail 44 for providing a cooling flow to the squealer tip rail 40. However, it should be understood that the present invention is not limited to the particular arrangement of squealer pocket cooling holes 48 disclosed herein, and other cooling flow arrangements or structures may be provided for cooling the squealer tip rail 40.

The outer wall 16 of the airfoil 12 may be provided with a plurality of film cooling holes 50 in the pressure sidewall 18 substantially adjacent an intersection of the outer wall 16 and the pressure side 32 of the squealer tip section 28. The film cooling holes 50 are in fluid communication with the cooling fluid circuit 49 in the airfoil 12 and provide a cooling fluid flow that may flow upwardly along the outer wall 16 of the airfoil 12 and pass over the outer surface and the radial outer edge of the pressure side tip rail 42. In addition, cooling holes 52 may also be provided along the trailing edge of the airfoil 12 and in fluid communication with the cooling fluid circuit 49.

Figure 2:
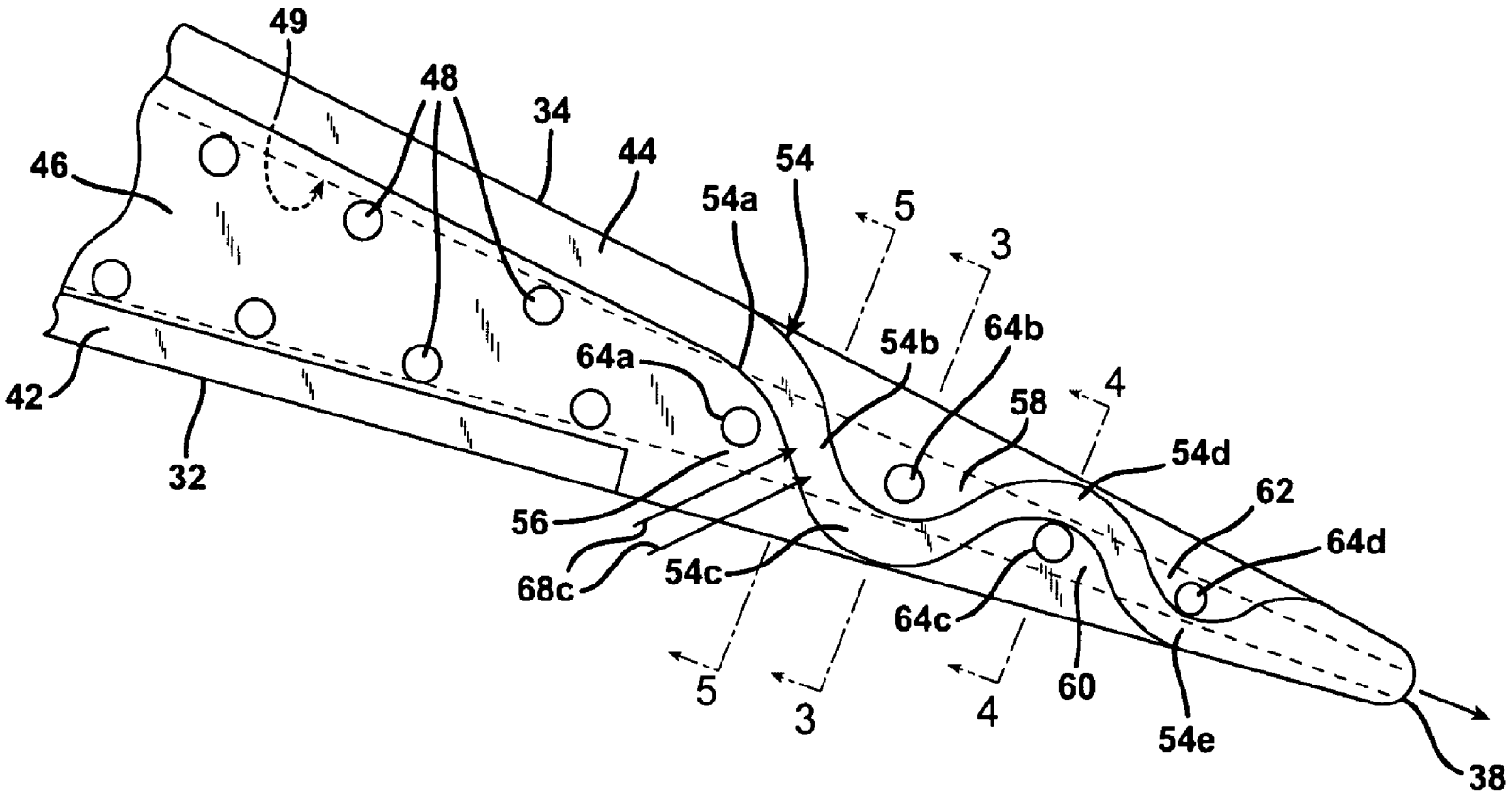
FIG. 2 is an enlarged top plan view of the trailing end of the turbine blade of FIG. 1.

Referring further to FIG. 2, the squealer tip rail 40 further comprises an aft portion 54 extending along a chordal location adjacent the trailing edge 38 of the squealer tip section 28. The chordal location of the aft portion 54 is generally defined by a portion of the squealer tip rail 40 where the pressure side tip rail 42 is discontinued at a location between the leading and trailing edges 36, 38, adjacent the trailing edge 38.

The suction side tip rail 44 continues to the trailing edge 38 in the aft portion 54 and is defined as a continuous wall traversing the blade tip surface 30 from the suction side 34 toward the pressure side 32 and back toward the suction side 34 in a repeating wavy or undulating pattern. In particular, the suction side tip rail 44 follows a curved undulating pattern in the aft portion 54 to define alternating forward and rearward facing pockets. In the illustrated embodiment, the aft portion 54 of the suction side tip rail 44 comprises first and second forward facing pockets 56, 60 defined by forwardly concave segments 54*a*, 54*d* of the aft portion 54, and first and second rearward facing pockets 58, 62 defined by rearwardly concave segments 54*c*, 54*e* of the aft portion 54. The forward facing pocket 56 comprises a transition pocket between the main squealer tip pocket 46 and the aft portion 54. In addition, each of the forward facing pockets 56, 60 includes a respective cooling hole 64*a*, 64*c* and each of the rearward facing pockets 58, 62 includes a respective cooling hole 64*b*, 64*d* in fluid communication with the cooling fluid circuit 49. The cooling holes 64*a*, 64*b*, 64*c*, 64*d* are preferably generally located along a centerline of the undulating aft portion 54, i.e., a line extending generally centrally between the pressure and suction sides 32, 34 along the chordal direction C.

Figure 5:
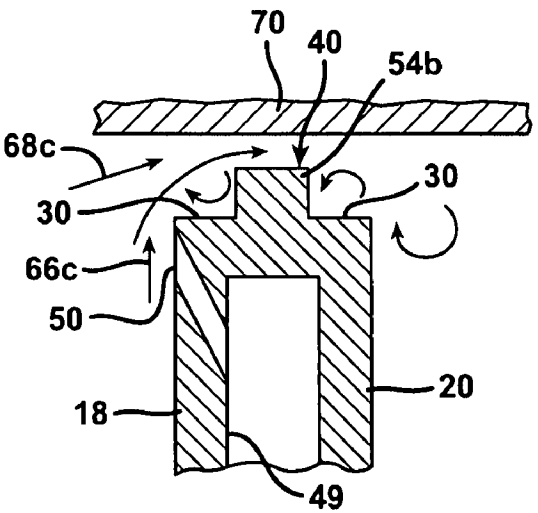
FIG. 5 is a cross-sectional view taken along line 5-5 in FIG. 2.
Figure 4:
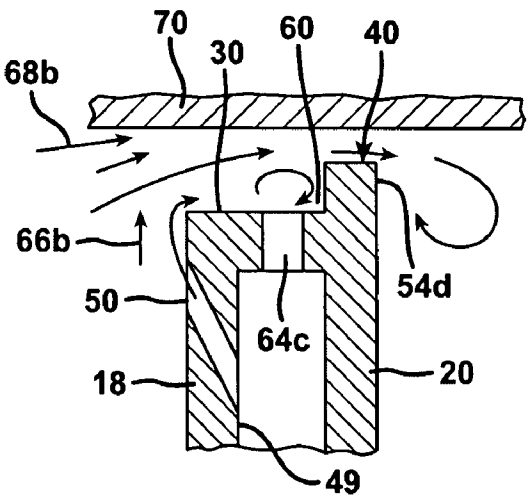
FIG. 4 is a cross-sectional view taken along line 4-4 in FIG. 2.
Figure 3:
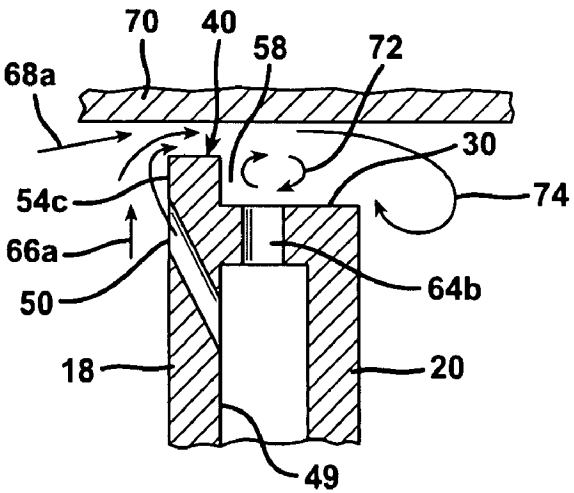
FIG. 3 is cross-sectional view taken along line 3-3 in FIG. 2.
Figure 6:
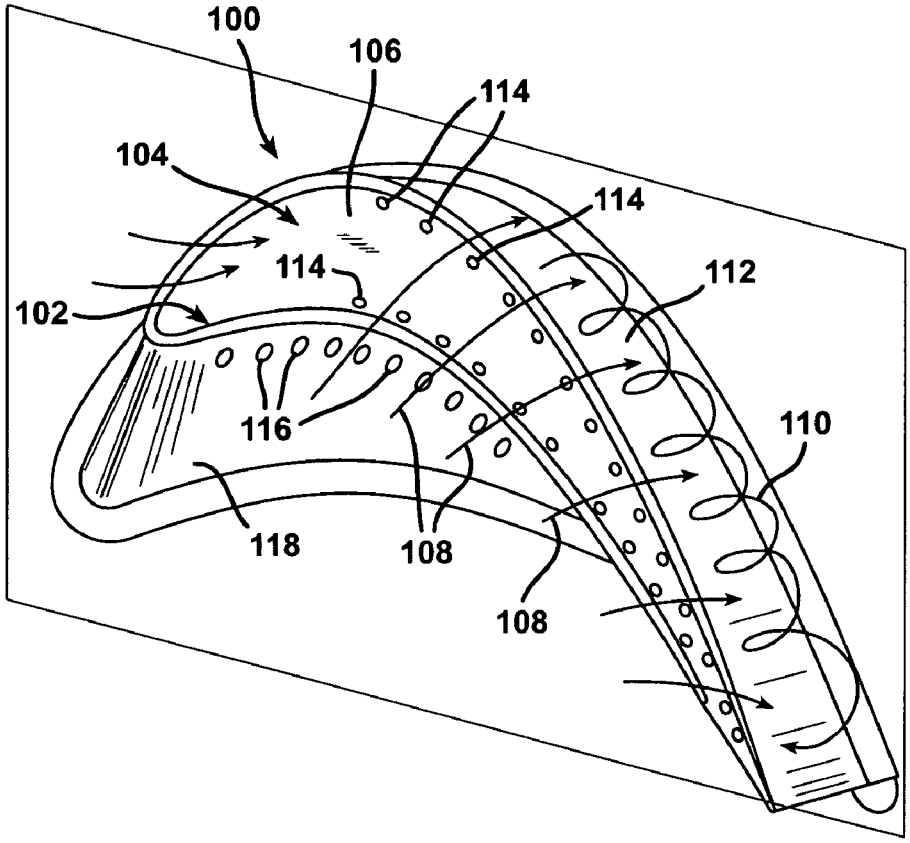
FIG. 6 PRIOR ART
FIG. 6 is a perspective view of a prior art turbine blade.
Figure 7:
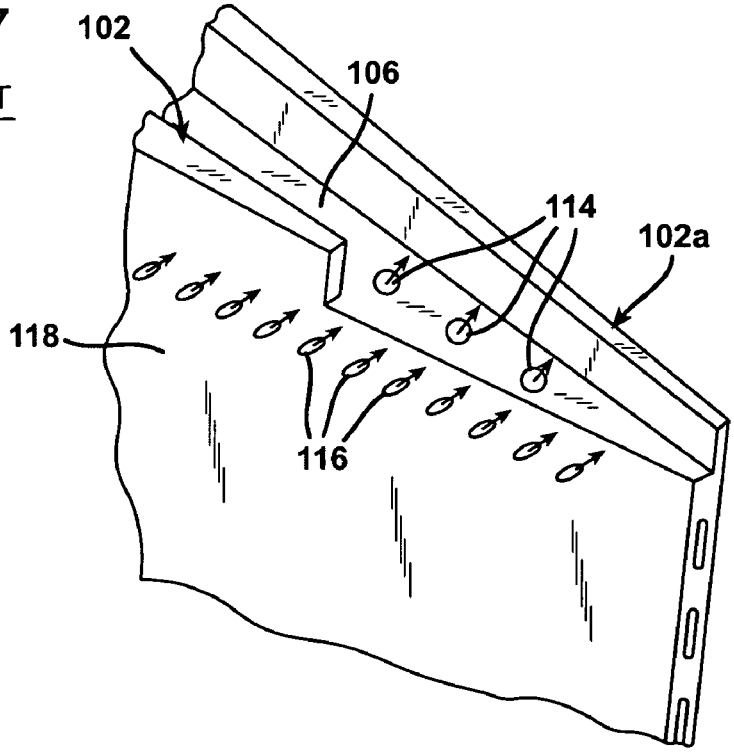
FIG. 7 PRIOR ART
FIG. 7 is a an enlarged perspective view of the trailing end of the prior art turbine blade of FIG. 6.

Referring to FIGS. 3-5, the operation of the aft portion 54 to limit secondary leakage flow and to cool the squealer tip section 28 will be described with reference to particular sections of the geometry defined by the aft portion 54. Due to the pressure gradient across the airfoil 12 from the pressure sidewall 18 to the suction sidewall 20, the secondary flow near the surface of the pressure sidewall 18 will migrate upwardly from the lower portion of the blade span, i.e., radially outwardly, and across the squealer tip section 28.

As seen in FIG. 3, the rearward facing pocket 58 defined by the section 54*c* of the aft portion 54 is located adjacent to the pressure sidewall 18. At the location of the section 54*c*, the cooling fluid from the cooling holes 50 in the pressure sidewall 18 will flow radially outwardly and push the secondary leakage flow near the pressure sidewall 18, indicated by flow lines 66*a*, radially outwardly against the oncoming streamwise leakage flow 68*a*. This radially traveling secondary leakage flow 66*a* will operate as a counterflow to reduce the oncoming streamwise flow 68*a*, as well as operate to push the secondary leakage flow 66*a* outwardly to the radially outer seal defined by an outer turbine shroud 70. In addition to the counterflow action, cooling fluid emitted from the cooling hole 64*b*, located on the suction side 34 of the aft portion section 54*c* in the rearward facing pocket, comprises a recirculating pocket of fluid 72 between the squealer tip rail 40 and the larger vortex 74 formed behind the suction sidewall 20. The dwell time of the cooling fluid emitted from the cooling hole 64*b* is increased by the recirculating pocket of fluid 72 to increase the cooling of the squealer tip rail 40. The recirculating pocket of cooling fluid 72 also operates to force the streamwise secondary flow 68*a* to bend outwardly which, in combination with the action of the radially traveling secondary flow 66*a* on the pressure side 32 of the section 54*c*, restricts the streamwise leakage flow 68*a* and creates a smaller vena contractor at the outer edge of the squealer tip rail 40 where the secondary flow necks down to pass between the squealer tip rail 40 and the outer turbine shroud 70 to cause an effective reduction in the secondary leakage flow area. The combination of the described flow effects on both the pressure side 32 and suction side 34 of the aft portion section 54*c* operates to reduce the secondary leakage flow across the squealer tip rail 40 at the section 54*c*. Further, it should be noted that since the width of the airfoil 12 between the pressure and suction sides 32, 34 is relatively small, the secondary leakage flow 68*a* traveling across the squealer tip rail 40 from the pressure side 32 and contributing to the recirculating flow 72 on the suction side 34 of the section 54*c* will not be able to reattach to the blade tip surface 30 within the pocket 58 such that heat transfer from the secondary leakage flow 68*a* to the blade tip surface 30 will be reduced. It should also be understood that the reduction in the secondary leakage flow 68*a* across the squealer tip rail 40 results in reduced heat transfer from the secondary leakage flow 68*a* as it passes between the squealer tip rail 40 and the outer turbine shroud 70.

As seen in FIG. 4, the forward facing pocket 60 defined by the section 54*d* of the aft portion 54 is located adjacent to the suction sidewall 20. At the location of the section 54*d*, the secondary leakage flow adjacent the pressure sidewall 18, indicated by flow lines 66*b*, will enter the forward facing pocket 60 and will exhibit flow characteristics of a developing flow at a low heat transfer rate. Cooling fluid entering the forward facing pocket through the cooling hole 64*c* operates to push the streamwise secondary leakage flow 68*b* outwardly toward the outer turbine shroud 70 as the secondary leakage flow 68*b* enters the channel between the squealer tip rail 40 and the outer turbine shroud 70. The cooling fluid flow causes a reduction in the vena contractor of the secondary leakage flow 68*b* across the edge of the section 54*d*. The reduced vena contractor corresponds to a reduced secondary leakage flow 68*b* and a consequent reduction in the heat transfer from the secondary leakage flow 68*b* to the squealer tip rail 40. In addition, a portion of the cooling fluid from the cooling hole 64*c* circulates in the pocket 60 to cool the pressure side of the squealer tip rail 40.

As seen in FIG. 2, the forward facing pocket 56 is defined by the section 54*a* and includes section 54*b* of the aft portion 54 extending between the suction sidewall 20 and the pressure sidewall 18. Referring to FIG. 5, at the location of the section 54*b*, the squealer tip rail 40 is cooled by cooling fluid emitted from the upstream cooling hole 64*a* on the pressure side 32 of the section 54*b* and by cooling fluid emitted from the downstream cooling hole 64*b* on the suction side 34 of the section 54*b*. Specifically, vortices including the cooling fluid are formed adjacent the blade tip surface 30 on the pressure and suction sides of the section 54*b* to convectively cool the squealer tip rail 40. In addition, the section 54*b* is cooled through conduction of heat to the blade tip surface 30 and convection of heat from the blade tip surface 30 to the cooling fluid conveyed through the underlying cooling fluid circuit 49. Further, the geometry of the section 54*b* comprises a substantially straight sealing edge that it is generally perpendicular to the direction of the streamwise secondary leakage flow 68*c* at the aft portion 54, as indicated by flow lines 68*c* in FIG. 2. The orientation of the section 54*b* relative to the flow direction, i.e., perpendicular to the flow, provides an effective barrier for limiting flow between the squealer tip rail 40 and the turbine shroud 70 along an extended length of the aft portion 54.

The creation of the above-described leakage flow resistance phenomena by the wavy or undulating geometry of the aft portion 54 of the squealer tip rail 40, in combination with the injection of cooling fluid flow, results in a very high resistance leakage flow path. The high resistance flow path effects a reduction in the secondary leakage flow, i.e., a reduction in the vena contractor, with a consequent reduction in heat transfer at the squealer tip rail 40. Accordingly, the cooling requirements at the blade tip are reduced by the described aft portion 54 of the squealer tip rail 40, reducing the requirements for cooling fluid supplied from the cooling fluid circuit 49.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine blade comprising:

an airfoil including an airfoil outer wall extending radially outwardly from a blade root;

a blade tip surface located at an end of said airfoil distal from said root, and including pressure and suction sides joined together at chordally spaced apart leading and trailing edges of said airfoil;

a squealer tip rail extending radially outwardly from said blade tip surface and comprising a pressure side tip rail and suction side tip rail, and said squealer tip rail including an aft portion formed as a continuation of said suction side tip rail and extending between said leading edge and said trailing edge adjacent said trailing edge;

said aft portion continuously traversing said blade tip surface from said suction side toward said pressure side and back toward said suction side; and wherein said pressure side tip rail is discontinued in the chordal location of said aft portion.

2. The blade of claim 1, including a plurality of chordally spaced cooling holes in said blade tip surface, said aft portion passing between said spaced cooling holes.

3. The blade of claim 1, said aft portion defining at least one pocket facing toward said pressure side and at least one pocket facing toward said suction side, each said pocket including a cooling hole in said blade tip surface.

4. The blade of claim 3, further including a plurality of cooling holes in said airfoil outer wall adjacent an intersection of said outer wall and said pressure side of said blade tip surface at the chordal location of said aft portion.

5. The blade of claim 1, wherein said aft portion traverses said blade tip surface between said pressure side and said suction side in a curved undulating path to define alternating forward and rearward facing pockets.

6. The blade of claim 5, including a plurality of cooling holes in said blade tip surface, said undulating path passing between said cooling holes.

7. The blade of claim 1, wherein said blade is a combustion gas turbine blade.

8. A turbine blade comprising:

an airfoil including an airfoil outer wall with pressure and suction sidewalls joined together at chordally spaced apart leading and trailing edges of said airfoil and extending radially outwardly from a blade root to a blade tip surface;

said blade tip surface including pressure and suction sides coinciding with said pressure and suction sidewalls;

a continuous squealer tip rail extending radially outwardly from and substantially continuously around said blade tip surface forming a radially outwardly open squealer pocket;

said squealer tip rail including an aft portion adjacent said trailing edge, said aft portion traversing said blade tip surface between said pressure side and said suction side in a curved undulating path to define alternating forward and rearward facing pockets.

9. The blade of claim 8, wherein said squealer tip rail comprises a pressure side tip rail and a suction side tip rail, said aft portion being formed as a continuation of said suction side tip rail.

10. The blade of claim 9, wherein said pressure side tip rail is discontinued in the chordal location of said aft portion.

11. The blade of claim 8, including a plurality of cooling holes in fluid communication with a cooling fluid circuit within said airfoil, said cooling holes located along a centerline extending through said aft portion.

12. The blade of claim 11, wherein each of said forward and rearward facing pockets includes at least one of said cooling holes.

13. The blade of claim 8, wherein said squealer tip rail extends substantially continuously around said blade tip surface.

14. The blade of claim 8, wherein said blade is a combustion gas turbine blade.

15. A combustion gas turbine blade comprising:

an airfoil including an airfoil outer wall with pressure and suction sidewalls joined together at chordally spaced apart leading and trailing edges of said airfoil and extending radially outwardly from a blade root to a blade tip surface;

said blade tip surface including pressure and suction sides coinciding with said pressure and suction sidewalls;

a continuous squealer tip rail extending radially outwardly from and substantially continuously around said blade tip surface forming a radially outwardly open squealer pocket;

said squealer tip rail including an aft portion adjacent said trailing edge, said aft portion traversing said blade tip surface between said pressure side and said suction side in a curved undulating path to define alternating forward and rearward facing pockets; and a plurality of cooling holes in fluid communication with a cooling fluid circuit within said airfoil, said cooling holes located in said blade tip surface within said forward and rearward facing pockets.

16. The blade of claim 15, wherein said squealer tip rail comprises a pressure side tip rail and a suction side tip rail, said aft portion being formed as a continuation of said suction side tip rail.

17. The blade of claim 16, wherein said pressure side tip rail is discontinued in the chordal location of said aft portion.

18. The blade of claim 17, including a plurality of cooling holes in fluid communication with said cooling fluid circuit and located in said pressure sidewall at the chordal location of said aft portion.

* * * * *